US011101603B2

(12) United States Patent
Hämmerling

(10) Patent No.: US 11,101,603 B2
(45) Date of Patent: Aug. 24, 2021

(54) PRINTED CIRCUIT BOARD CONNECTOR WITH A SHIELD ELEMENT

(71) Applicant: HARTING Electronics GmbH, Espelkamp (DE)

(72) Inventor: Sergej Hämmerling, Bohmte (DE)

(73) Assignee: HARTING Electronics GmbH, Espelkamp (DE)

( * ) Notice: Subject to any disclaimer, the term of this patent is extended or adjusted under 35 U.S.C. 154(b) by 0 days.

(21) Appl. No.: 16/630,551

(22) PCT Filed: Jun. 28, 2018

(86) PCT No.: PCT/DE2018/100594
§ 371 (c)(1),
(2) Date: Jan. 13, 2020

(87) PCT Pub. No.: WO2019/011372
PCT Pub. Date: Jan. 17, 2019

(65) Prior Publication Data

US 2021/0091511 A1 Mar. 25, 2021

(30) Foreign Application Priority Data

Jul. 14, 2017 (DE) ..... 10 2017 115 914.2

(51) Int. Cl.

| | |
|---|---|
| ***H01R 13/6581*** | (2011.01) |
| ***H01R 13/502*** | (2006.01) |
| ***H01R 13/6594*** | (2011.01) |
| ***H01R 43/20*** | (2006.01) |
| ***H01R 12/71*** | (2011.01) |

(52) U.S. Cl.
CPC ..... *H01R 13/6581* (2013.01); *H01R 13/502* (2013.01); *H01R 13/6594* (2013.01); *H01R 43/205* (2013.01); *H01R 12/716* (2013.01)

(58) Field of Classification Search
CPC ..... H01R 13/6581; H01R 13/6594; H01R 13/502; H01R 43/205; H01R 12/716
USPC ..... 439/607.27, 607.35
See application file for complete search history.

(56) References Cited

U.S. PATENT DOCUMENTS

| | | | | |
|---|---|---|---|---|
| 4,842,555 A | | 6/1989 | Cosmos et al. | |
| 5,017,158 A | | 5/1991 | Liu et al. | |
| 5,041,022 A | | 8/1991 | Sekiguchi | |
| 5,928,035 A | * | 7/1999 | Jankowsky | H01R 12/707 439/607.36 |

(Continued)

FOREIGN PATENT DOCUMENTS

| | | |
|---|---|---|
| CN | 102792528 A | 11/2012 |
| CN | 104466545 A | 3/2015 |

(Continued)

*Primary Examiner* — Gary F Paumen
(74) *Attorney, Agent, or Firm* — Smartpat PLC

(57) ABSTRACT

A shield element (1) of a printed circuit board connector enables maximum tolerance compensation between a printed circuit board (5), on which the printed circuit board connector is secured on the connection side, and a housing wall (4) of a device housing surrounding the printed circuit board (5). The shield element (1) is substantially hollow-cylindrical and can be fitted onto the insulating body (2) on the insertion side so as to also ensure a required connection to ground over the large desired tolerance range.

14 Claims, 8 Drawing Sheets

(56) References Cited

U.S. PATENT DOCUMENTS

| | | | | |
|---|---|---|---|---|
| 6,319,051 | B1 * | 11/2001 | Chang | H01R 13/6641 439/488 |
| 6,361,373 | B1 * | 3/2002 | Horchler | H01R 43/20 439/701 |
| 6,464,523 | B1 * | 10/2002 | LeVine | H01R 13/5202 439/271 |
| 6,547,591 | B2 * | 4/2003 | Okabe | H01R 13/743 439/557 |
| 7,632,145 | B1 | 12/2009 | Lin et al. | |
| 2007/0054549 | A1 | 3/2007 | Söfker | |
| 2012/0329324 | A1 | 12/2012 | Hoeppner | |
| 2013/0137310 | A1 | 5/2013 | Genau | |
| 2015/0325956 | A1 | 11/2015 | Schreier et al. | |
| 2016/0020560 | A1 | 1/2016 | Ju et al. | |
| 2016/0285179 | A1 | 9/2016 | Zebhauser et al. | |
| 2016/0315427 | A1 | 10/2016 | Kawakami et al. | |

FOREIGN PATENT DOCUMENTS

| | | | |
|---|---|---|---|
| CN | 204391417 | U | 6/2015 |
| CN | 105409063 | A | 3/2016 |
| CN | 106067628 | A | 11/2016 |
| DE | 10347306 | | 10/2005 |
| DE | 102010051954 | | 2/2012 |
| DE | 102012105256 | A1 | 12/2013 |
| EP | 0390929 | A1 | 10/1990 |

* cited by examiner

PRINTED CIRCUIT BOARD CONNECTOR WITH A SHIELD ELEMENT

TECHNICAL FIELD

The disclosure relates to a printed-circuit-board connector with a shield element.

BACKGROUND

Printed-circuit-board connectors are needed in device-coupling technology. They are conventionally soldered, on the coupling side, onto a printed circuit board which is arranged in a housing of an electrical device—that is to say, in a device housing. An associated connector housing can be incorporated into a housing wall of the device housing. In the mounted state of the device, the insulating body (contact-carrier) of the printed-circuit-board connector enters the connector housing but, in order to guarantee a mechanical tolerance compensation between printed circuit board and housing wall that is necessary as regards device construction, has not been fixed to its connector housing. For grounding and shielding reasons, however, a reliable electrically conducting ground connection between the connector housing and the printed circuit board is necessary. This connection can, for example, be established by a shield element.

Printed publication DE 10 2010 051 954 B3 presents a round connector on its coupling side for contacting on printed circuit boards is provided. For the purpose of attenuating the crosstalk, an electrically conducting shield cross, connected in conducting manner to the printed circuit board, is provided which is surrounded by a likewise cruciform contact-carrier, in the obliquely formed inner edges of which there are provided receiving grooves for holding the electrical contacts. The electrically non-conducting round body, which ultimately is, in turn, surrounded by an electrically conducting connector housing, is pushed over this cruciform arrangement.

Moreover, it is disclosed that the insulating round body exhibits, roughly centrally in relation to its length, a circumferential notch into which a shield spring has been inserted, whereby the shield spring—which, in particular, may have been realized as a spiral spring—contacts by means of slots provided in the round body, on the one hand, the electrically conducting shield cross and, on the other hand, the electrically shielding connector housing surrounding the round body. This connector housing is capable of being incorporated, in the form of a front-panel insert, into an electrically conducting device housing, and capable of being connected to a mating connector supplied from outside.

Printed publication DE 10 2012 105 256 A1 presents a comparable printed-circuit-board connector. In this document, a spring lock washer is presented which evidently possesses a suitable contour in order to contact electrically, on the one hand, the shield cross and, on the other hand, a connector housing into which the insulating body is plugged.

Finally, printed publication DE 103 47 306 B4 presents a shield link between a printed circuit board receiving electrical and/or electronic components, which is arranged in a housing, and at least one coupling socket, arranged in a wall of the housing, with a metallic, cylindrical socket sheath. The shield link consists of a metallic, annular shield element which exhibits, in each instance away from the ring plane, contact pins, protruding on the one ring side, for the mechanical and electrical connection to the printed circuit board, and spring legs, protruding on the other ring side, for contacting the socket sheath. Between these contact pins the socket sheath of the connector housing has been inserted coaxially in relation to the shield element.

A significant disadvantage of this prior art consists in the fact that the tolerance between the printed circuit board and the housing wall is too small for some applications or structural designs of the device.

The German Patent and Trademark Office has searched the following state of the art in the priority application relating to the present application: U.S. Pat. Nos. 5,017,158 A and 4,842,555 A.

SUMMARY

The object of the disclosure is to provide a shield element of a printed-circuit-board connector that makes a tolerance compensation possible that is as large as possible between a printed circuit board, on which the printed-circuit-board connector is fastened on the coupling side, and a housing wall of a device housing surrounding the printed circuit board. At the same time, an electrically conducting ground connection between the printed circuit board and a connector housing incorporated into the housing wall is to be guaranteed over the entire tolerance range.

This object is achieved by the features as claimed. Advantageous configurations of the invention are specified in the dependent claims.

The printed-circuit-board connector has at least one insulating body, a shield element and a metallic connector housing.

The shield element has been realized in one piece and formed from a metallic sheet which for the positive grasping of a substantially cylindrical central portion of the insulating body has been bent substantially in the form of a hollow cylinder.

The shield element has contact tabs, jutting radially outward, for the electrical contacting of the preferably metallic connector housing.

The shield element has a ground terminal for contacting a ground contact of a printed circuit board.

The insulating body has, adjoining its central portion, a plug-in region and, situated opposite, a coupling region. The shield element is capable of being plugged onto the central portion of the insulating body on the plug-in side—that is to say, from the direction of the plug-in region.

For this purpose, it is an advantage if the diameter of the coupling region is larger than the diameter of the central portion, and the diameter of the central portion is at least as large as the diameter of the plug-in region. In this connection and in the following, the diameter at the thickest point in each instance is, of course, meant.

By the term "substantially cylindrical", it is to be understood that the central portion of the insulating body has a cylindrical basic form but deviates therefrom at some places—that is to say, for example, for the polarization/alignment of the shield element to be arranged thereon it may have been flattened and may, moreover, exhibit recesses and/or molded-on parts which, for example, serve for fastening the shield element to the insulating body.

The term "substantially hollow cylindrical" implies that, in its basic form, the shield element has been bent into a hollow cylinder, but that its form may deviate therefrom at some places by, for example, the contact tabs having been stamped out of the sheet and jutting outward slightly from the hollow cylinder, and/or that window-like recesses for interacting with molded-on parts of the insulating body may be present at the edge of the hollow cylinder, that for its polarization/alignment on the correspondingly shaped insulating body the shield element may likewise have been flattened, and that the ground contact may have been molded onto the hollow cylinder as a soldering pin and points away from said hollow cylinder, in order, for example, to contact a ground terminal of the printed circuit board electrically.

These deviations from the cylindrical and the hollow cylindrical form have been mentioned by way of example and may have been realized in any combination or individually.

In the following, the term "electrical device" in a general sense is also intended to encompass the term "electronic device", in order to simplify the wording. By the term "connector", which is used frequently on account of the simple wording, in the following the printed-circuit-board connector is to be understood.

The advantage of the invention consists in the fact that the tolerance range between said housing wall and the printed circuit board is increased by this structural design. This is particularly advantageous for the production of electrical/electronic devices, which as a result experiences greater flexibility mechanically.

A further advantage consists in the fact that the shield element has a shielding action itself by virtue of its substantially hollow cylindrical form.

Two first edges of the sheet may face one another, in particular in parallel, by virtue of the form of said sheet which has been bent so as to be substantially hollow and cylindrical. In this connection there may be a gap between them. But they may also abut one another. If they have not been fastened to one another, the shield element is particularly elastic, which may facilitate mounting somewhat. But they may also have been fastened to one another, as a result of which the shield element possesses particularly high stability. For their reciprocal fastening, they may, for instance, exhibit a shape similar to a piece of a jigsaw puzzle and may as a result be interlocked—that is to say, in a manner similar to the principle of a so-called "dovetail joint" in which, conventionally, a conical peg is held in positive manner in a corresponding recess. As a result, the two first edges of the sheet, which preferably abut one another by virtue of the hollow cylindrical form of the shield element, can be fastened to one another with only extremely little effort.

Advantageously, the shield element is capable of being fixed to the insulating body, having, of course, a positive effect on the stability and reliability of the connector. In particular, in its mounted state—that is to say, in its state where it has been plugged onto the central portion—the shield element is capable of being fixed to the insulating body.

In an advantageous configuration, the fastening of the shield element to the insulating body can be realized by the insulating body exhibiting on its central portion, adjoining the coupling region, several right-parallelepipedal molded-on parts, namely so-called "ribs". These ribs have the additional advantage that the mounted shield element is no longer capable of being twisted with respect to the insulating body. The ribs consequently have the function of a so-called "anti-torsion device", also called a "torsion-preventing device". For this purpose, on its edge adjoining the coupling region in the plugged-on state the shield element possesses window-like recesses, open toward the edge, for grasping the ribs. On two inner edges, situated opposite one another, of these recesses there are arranged, in each instance, barbs for fastening the plugged-on shield element to the insulating body. Consequently, the ribs additionally also have a holding function, fixing the shield element also in the plug-in direction.

This is particularly advantageous, because, as a result, the shield sheet is capable of being fixed to the insulating body also after being plugged onto it, which has occurred contrary to the plug-in direction.

In principle, the ground terminal of the shield element may consist of a soldering pin. This soldering pin may likewise have been stamped out of the sheet using stamping/bending technology, and may therefore have a flat shape, may couple directly onto the hollow cylinder and, as a result, may of course have been integrally connected thereto. Advantageously, the insulating body possesses a corresponding receptacle, into which the soldering pin is capable of being inserted and/or has already been inserted vis a partial region, in particular by positive closure and preferably also by force closure. But with respect to the aforementioned configuration the soldering pin may also exhibit, preferably on both sides, barbs which, in the course of insertion into the receptacle of the insulating body, interlock with the edges thereof.

In an alternative configuration, the insulating body may exhibit several latching recesses for fastening the shield element to its central portion. The shield element then possesses for this purpose several latching arms, free-standing on three sides and jutting inward, which in the mounted state, pointing in the direction of the plug-in region, have been latched in the latching recesses of the insulating body and, as a result, prevent the shield element from being withdrawn from the insulating body in the plug-in direction.

This variant has the advantage that the latching arms latch in the insulating body in the course of mounting. In particular, this can be done with an audible noise. As a result, in the course of mounting it is additionally made clear that the shield element has been mounted on the insulating body and is accordingly located in an unambiguously defined, definitive position in relation to the insulating body. Also, the latching arms can also be unlatched again when required, for example with a screwdriver, in order to disassemble the shield element in non-destructive manner, if this is desired.

Advantageously, the shield element is a stamped and bent part which is capable of being produced in automated manner with only slight effort and with low costs.

A connector of such a type can be employed in an electrical device, for instance. The electrical device possesses at least one device housing, a printed circuit board arranged in the device, and said connector. The insulating body of the connector has been fixed on the printed circuit board on the coupling side, for instance by one or more associated guide pegs and/or by soldering of electrical contacts, received in the insulating body and preferably fixed therein, on the printed circuit board.

The connector housing has been incorporated into a housing wall of the device housing. As already mentioned, the shield element has been mounted on the insulating body, contrary to the plug-in direction, and may, as a result, have been advantageously designed to have a particularly large surface area in the plug-in direction, in order with its contact tabs to contact the connector housing electrically over a mechanical tolerance range that is as large as possible. Finally, in this way the contact tabs have been arranged relatively close to the housing wall and, as a result, a comparatively long way down in the connector housing, distinctly increasing said tolerance range. The shield element has been connected in electrically conducting manner by its ground terminal to a ground contact of the printed circuit board, in order in this way to establish an electrical ground connection between the connector housing, being floatingly arranged relative to the shield element, and the printed circuit board.

This arrangement has the advantage that somewhat larger deviations from the standard dimensions may also be found in the electrical device, without the ground connection between the connector housing and the printed circuit board being interrupted.

The printed-circuit-board connector can be mounted in accordance with a method having the following steps:

a. The shield element is plugged, contrary to the plug-in direction, onto the central portion of the insulating body and fixed to the insulating body.
b. Thereupon the insulating body with its plug-in region and its central portion is pushed into the connector housing, whereby the contact tabs contact the connector housing electrically.

The insulating body may have been provided with contacts located therein which were soldered onto a printed circuit board on the coupling side already prior to method step a. Between method step a. and method step b., the shield element can be soldered by its soldering pin onto a ground terminal of the printed circuit board.

Prior to method step b., the connector housing can be incorporated into a housing wall of a device housing.

The spacing between the printed circuit board and the device housing may, as a result, vary within a comparatively large tolerance range. Within this tolerance range, the connector housing is connected in electrically conducting manner to a ground terminal of the printed circuit board via the contact tabs of the shield element, as a result of which interfering signals are conducted away from the device housing to the printed circuit board, in particular to said ground contact of the printed circuit board.

BRIEF DESCRIPTION OF THE DRAWINGS

An embodiment of the invention is represented in the drawings and will be elucidated in more detail in the following.

DETAILED DESCRIPTION

The figures present partly simplified, schematic representations. In part, identical reference symbols are used for like but possibly not identical elements. Different views of the same elements might have been scaled differently.

Figure 1A:
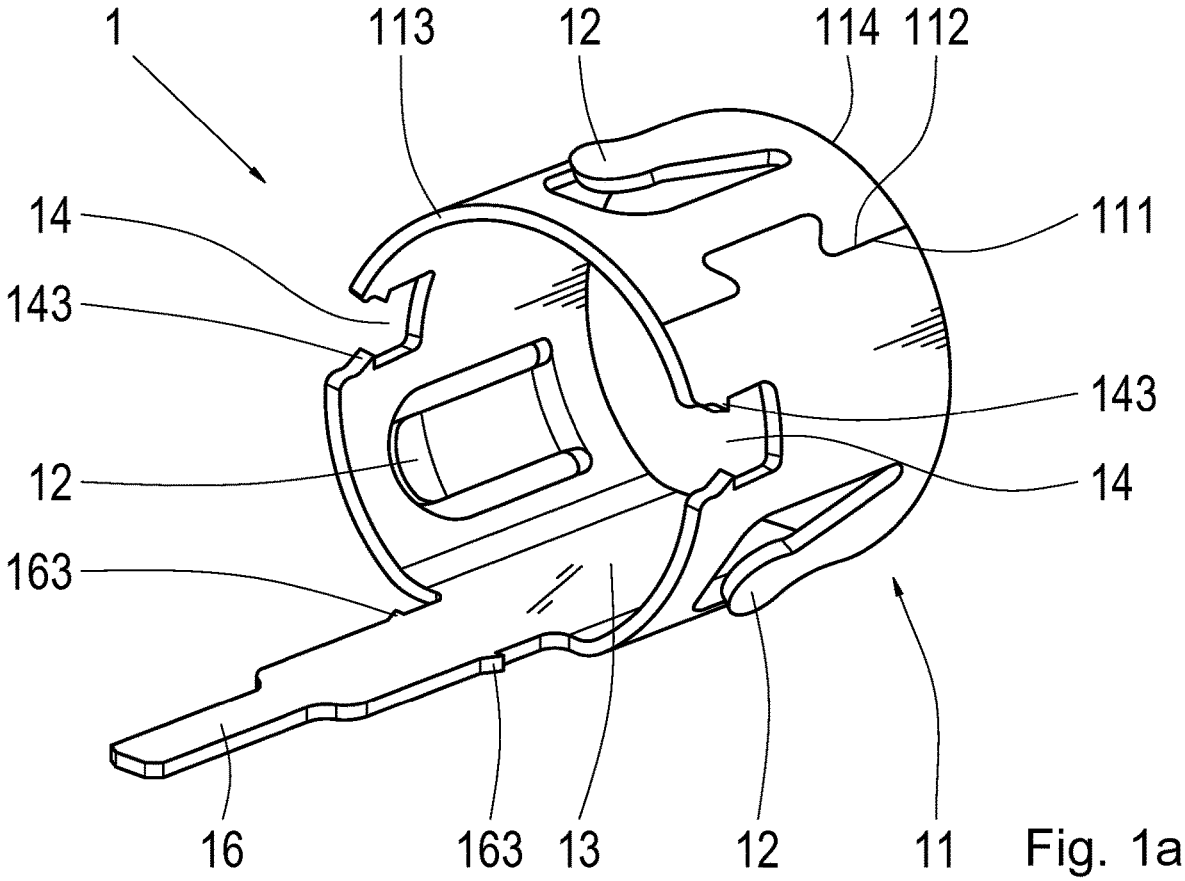
FIGS. 1*a, b* show a shield element in an oblique view and in a rear view.

FIG. 1*a* shows a shield element 1 in an oblique view. The shield element 1 has been realized in one piece and formed from a metallic sheet 11 which has been bent substantially in the form of a hollow cylinder. In this case, the first edges 111, 112, abutting one another as a result, of the sheet have been fastened to one another by virtue of their contour that is shaped to be similar to a piece of a jigsaw puzzle (in a manner similar to the dovetail principle).

The shield element 1 exhibits contact tabs 12, jutting radially outward, for the electrical contacting of a connector housing 3.

The shield element 1 further possesses two free-standing second edges 113, 114. On the first of these two second edges 113 the shield element 1 possesses a soldering pin 16 as ground terminal for contacting a ground contact of a printed circuit board 5. The radially outwardly jutting contact tabs 12 and the ground terminal 16 are arranged axially spaced from one another at opposite ends of the shield element 1. In the variant shown here, the soldering pin 16 tapers toward its end, in order to be plugged through a through-hole of the printed circuit board 5 and soldered thereto. Alternatively, other variants of the soldering pin 16', 16" are shown in FIG. 6. In the region of the planar soldering pin 16, the sheet 11, which has otherwise been bent substantially in the form of a hollow cylinder, possesses a flattened region 13 for guaranteeing the correct orientation of the shield element 1 on the insulating body 2.

Moreover, on this first free-standing edge 113 the shield element 1 possesses rectangular window-like recesses 14, open toward the edge 113, as an anti-torsion device. On two inner edges, situated opposite one another, of these window-like recesses 14 there are arranged, in each instance, barbs 143 for fixing the shield element 1 to the insulating body 2. The soldering pin 16 also possesses, on both sides, barbs 163 of such a type for fixing to the insulating body 2.

Figure 1B:
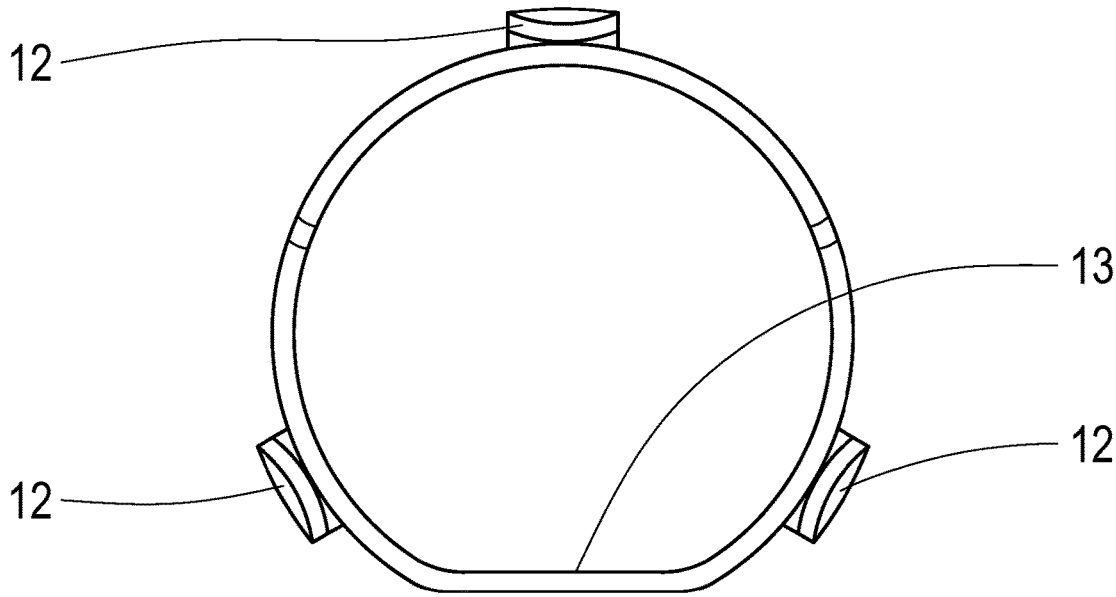
Figure 2A:
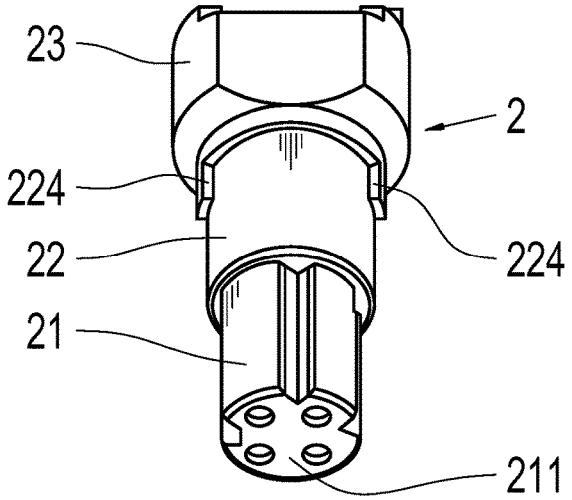
FIGS. 2*a-d* show an insulating body in four different views.
Figure 2B:
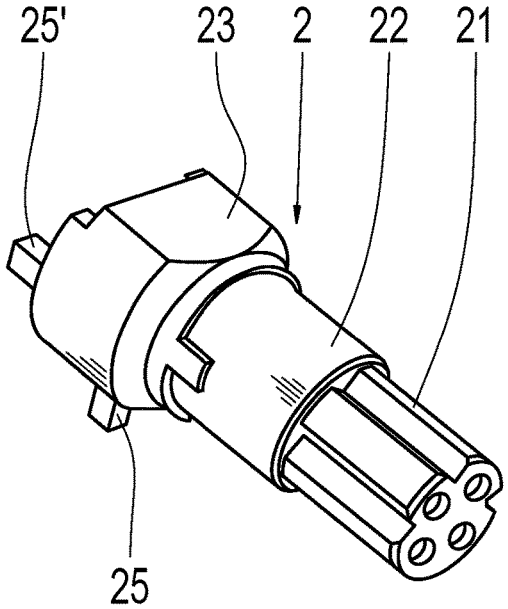
Figure 2C:
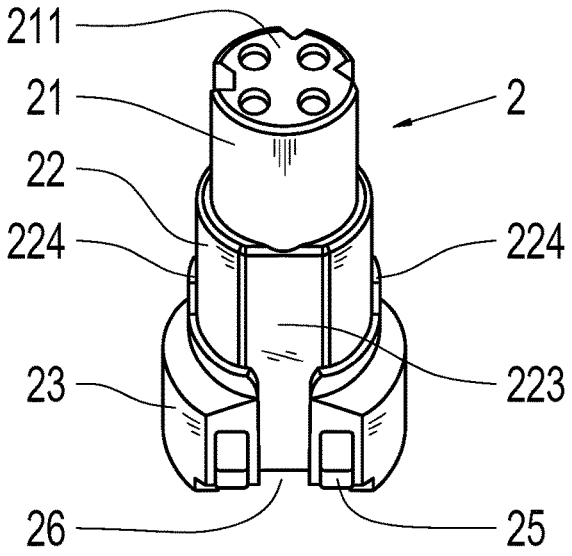
Figure 2D:
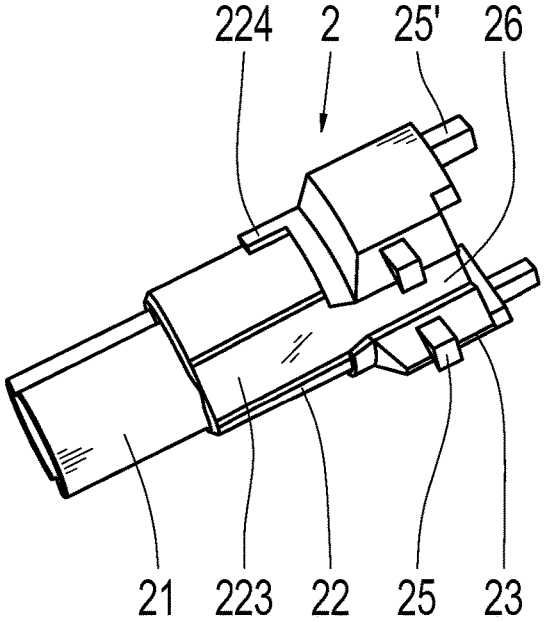

FIG. 1*b* shows the shield element 1 in a rear view. In this representation, the flattened region 13 can be discerned particularly well.

Consequently, the ribs 224 additionally also have a holding function, fixing the shield element 1 also in the plug-in direction.

FIGS. 2*a-d* show the associated insulating body 2 from different views. In this case, the insulating body 2 possesses a female plug-in face which is distinguished in that it possesses socket contact openings 211 for receiving socket contacts which are not shown. However, to a person skilled in the art it is, of course, clear that it might just as well be a question of a male plug-in face which has been realized for the reception of pin contacts.

The insulating body 2 shown here therefore possesses a female plug-in region 21, a substantially cylindrical central portion 22 and a coupling region 23. Adjacent to the coupling region 23, ribs 224—approximately rectangular in cross-section, disregarding the cylindrical curvature of the surface—have been molded on the surface of the central portion 22, which are capable of being inserted as an anti-torsion device into the window-like recesses 14 of the shield element 1.

For the purpose of alignment and possibly also for the purpose of fastening on a printed circuit board, the insulating body 2 possesses guide pegs 25, 25' for the horizontal and vertical alignment of the insulating body 2 on the printed circuit board.

On its side facing toward the printed circuit board in the horizontal alignment, the coupling region 23 possesses, between the two associated guide pegs 25, 25', a receptacle 26 for receiving at least one region of the soldering pin 16. Immediately adjoining this, the insulating body 2 possesses a flattened section 223 on its central portion 22.

Figure 3:
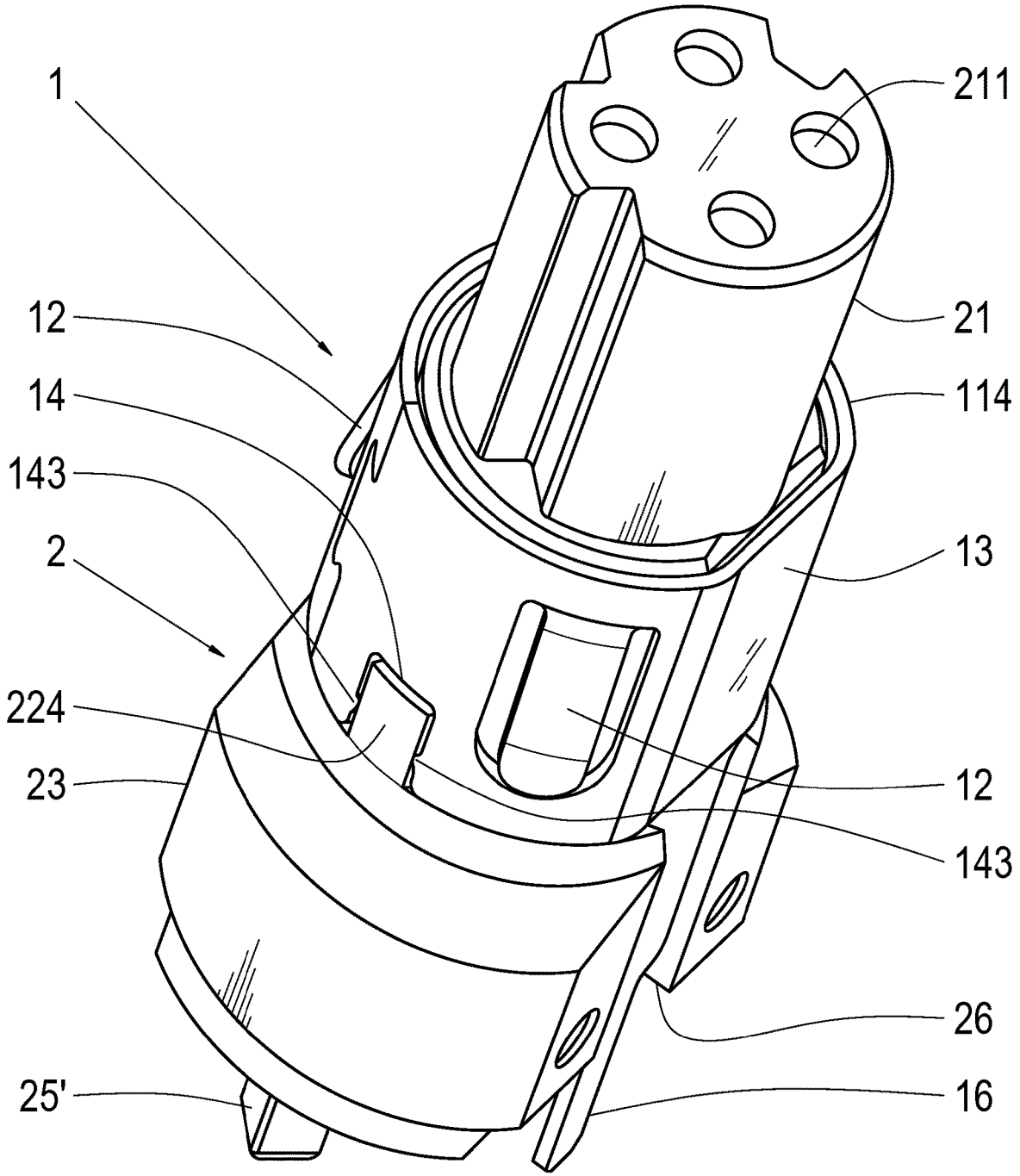
FIG. 3 shows the insulating body with the shield element fixed thereon.

FIG. 3 shows the insulating body 2 with the plugged-on shield element 1. It is readily apparent that the shield element 1 was plugged, contrary to the plug-in direction, via the plug-in region 21 onto the central portion 22, not indicated in this representation for reasons of clarity. For this purpose, it is advantageous that the plug-in region 21 possesses a smaller diameter than the central portion 22, and the central portion 22 possesses a smaller diameter than the coupling region 23. In this connection, the diameter is, of course, to be ascertained at the thickest point of the respective region/portion 21, 22, 23.

The window-like recesses 14 of the shield element 1 grasp the ribs 224 of the insulating body 2 and interlock with the ribs 224 on both sides with their barbs 143. As a result, the shield sheet 1 has been fixed to the insulating body 2. The window-like recesses 14 grasp the ribs 224 with their barbs 143 at least by force closure. The ribs 224 and the window-like recesses 14 also continue to act as an anti-torsion device.

The flattened region 13 of the shield element 1 and the flattened section 223 of the insulating body 2 rest on one another and act together as a polarizing element—that is to say, they prevent plugging-on in the wrong orientation.

The contact pin 16 has been partly arranged in the receptacle 26 and projects with its end, not indicated in any detail, beyond the coupling region 23 of the insulating body 2, in order to be plugged through a through-hole of the printed circuit board 5 and soldered to a corresponding ground contact of the printed circuit board 5.

In FIGS. 4*a-d* the insulating body 2 has already been fastened on the printed circuit board 5 and provided with the shield element 1. The connector housing 3 is a built-in housing which has been incorporated into a housing wall 4 of an electrical device. In these figures the printed circuit board 5 and the housing wall 4 have only been shown partially.

It goes without saying that it may actually be a question of a relatively large printed circuit board 5 which is located in the interior of a housing of the electrical device, and that the housing wall 4 is an integral part of the housing.

Figure 4A:
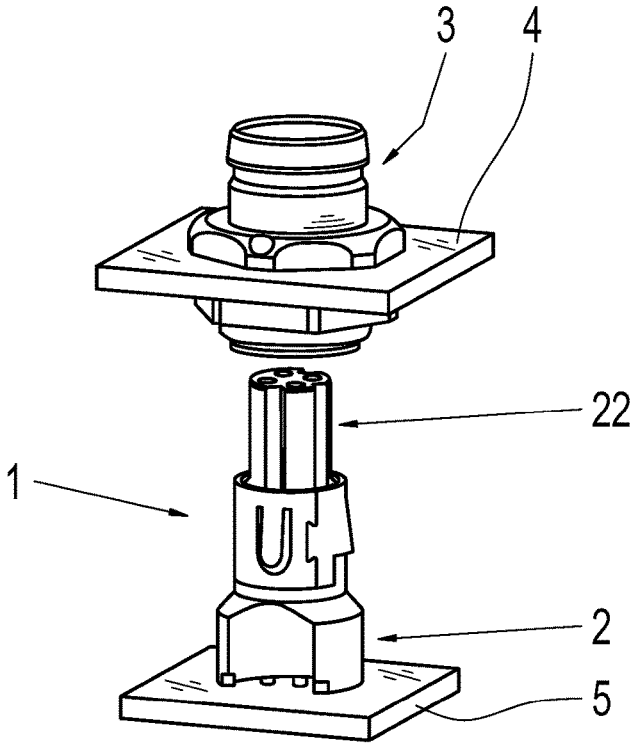
FIGS. 4*a-d* shows the inserting of the plug-in region of the insulating body into the connector housing, from two different views.
Figure 4B:
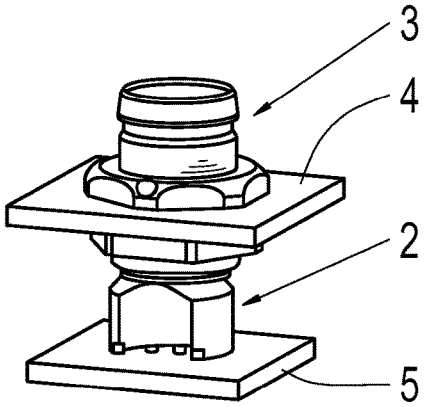
Figure 4C:
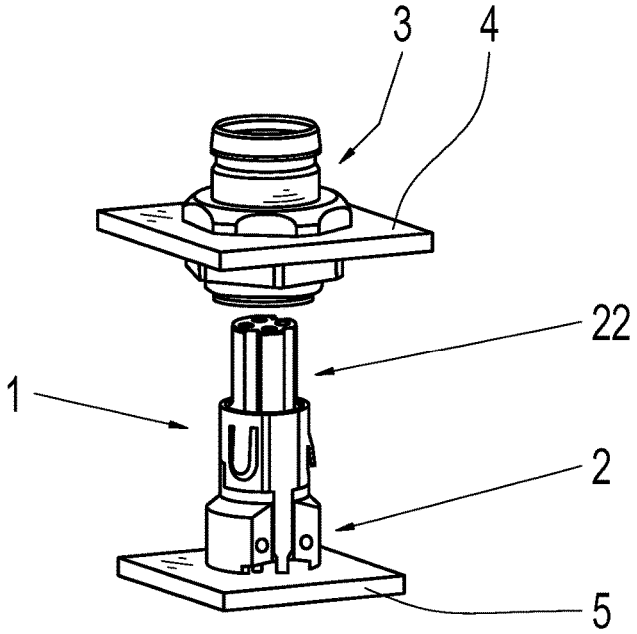
Figure 4D:
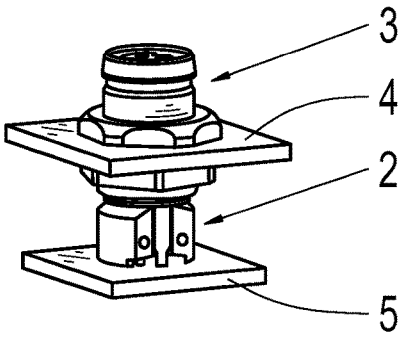

In two phases in each case, in FIGS. 4*a* and *b* and also in FIGS. 4*c* and *d*, it is shown, from two different perspectives, how the insulating body 2 with its plug-in region 21 enters the connector housing 3 without having been fastened thereto. In device-construction technology a certain tolerance between the housing wall 4 and the printed circuit board 5 is made possible as a result.

It is readily apparent that the substantially cylindrical shield sheet 1 grasping the insulating body 2 with its long contact tabs 12 makes possible, by virtue of this structural design, makes possible a very large tolerance range of the geometrical spacing between the connector housing 3 and the shield element 1 and hence also the ground terminal of the printed circuit board 5. Within this tolerance range, the ground connection between the connector housing 3 and, consequently, the metallic housing wall 4 of the metallic device housing, on the one hand, and the ground terminal of the printed circuit board 5, on the other hand, is guaranteed. In the assembled state illustrated in FIG. 4*b* and FIG. 4*d*, the metallic connector housing 3 overlaps the central portion 22 but not the coupling region 23 of the insulating body 2.

Figure 5:
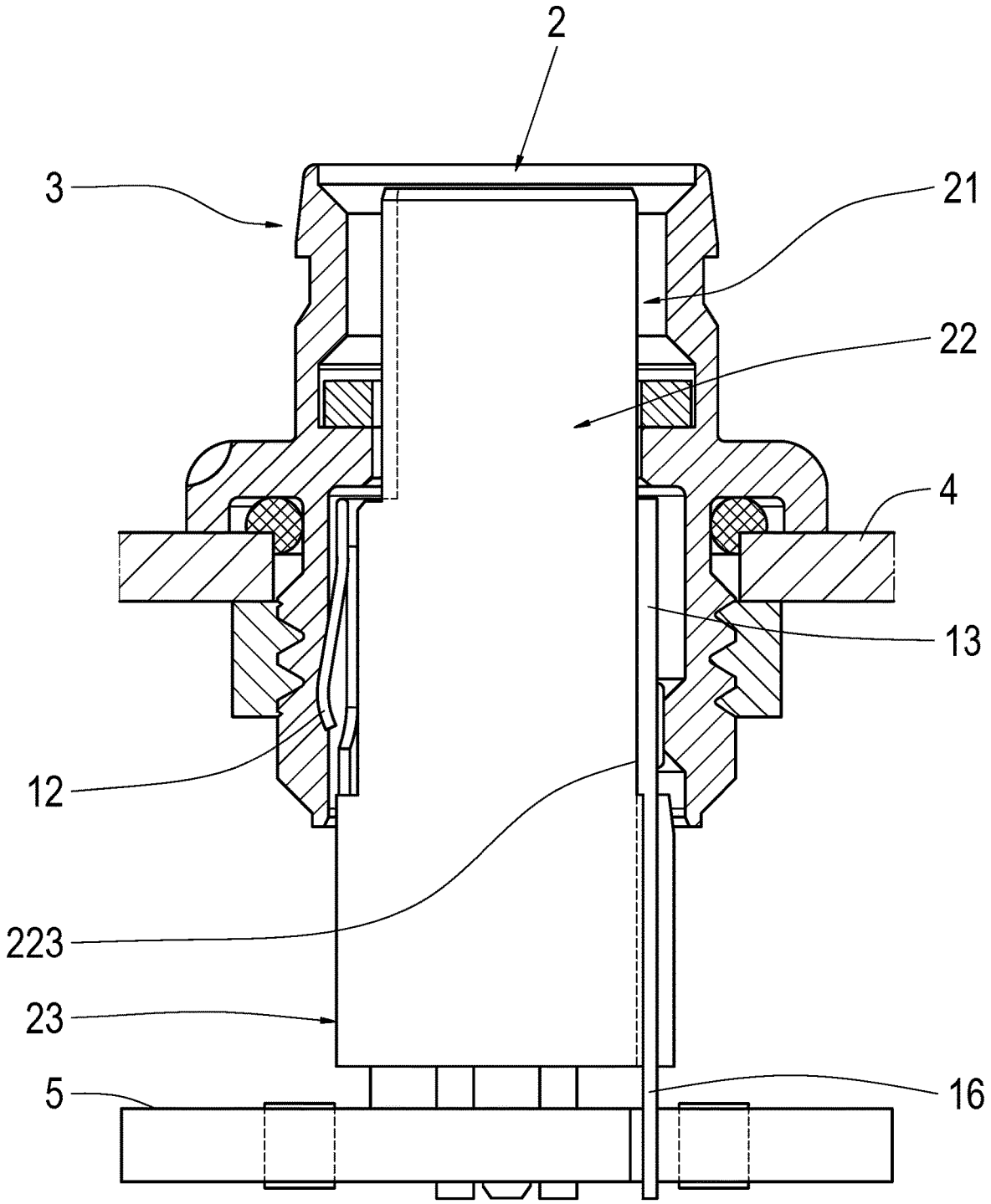
FIG. 5 shows the insulating body inserted into the connector housing, in cross-section.

FIG. 5 illustrates this state of affairs in a cross-sectional representation. Centrally, the insulating body 2 can be seen which, represented at the top in the drawing, enters the connector housing 3 with its plug-in region 21. On its central portion 22 said insulating body is grasped by the substantially hollow cylindrical shield element 1, the contact tabs 12 of which contact the connector housing 3 electrically toward the outside.

It is readily apparent that an increase of the spacing between the printed circuit board 5 and the housing wall 4 over a relatively large tolerance range might take place without the electrical contact breaking away between the contact tab 12 shown and the connector housing 3.

Figure 6A:
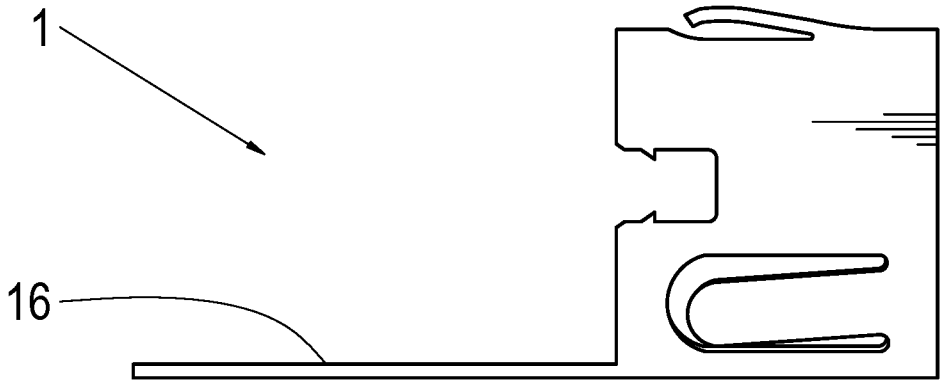
FIG. 6 shows the shield element with various soldering pins.
Figure 6B:
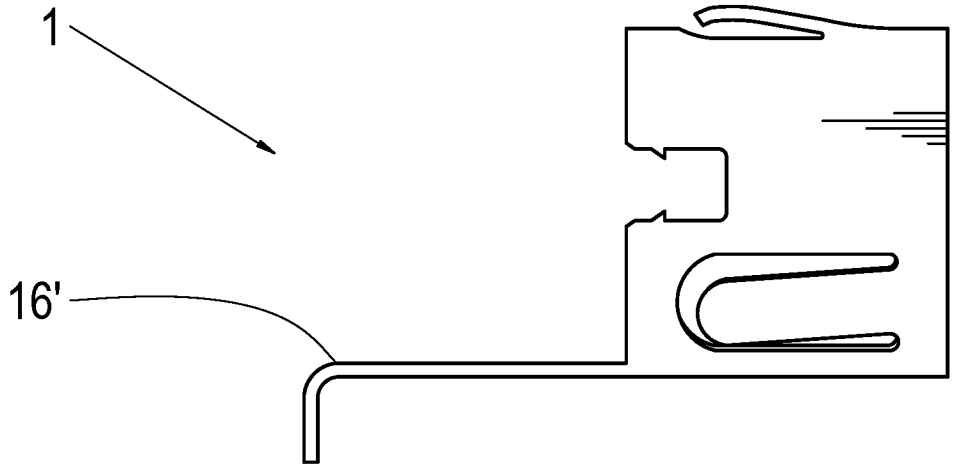
Figure 6C:
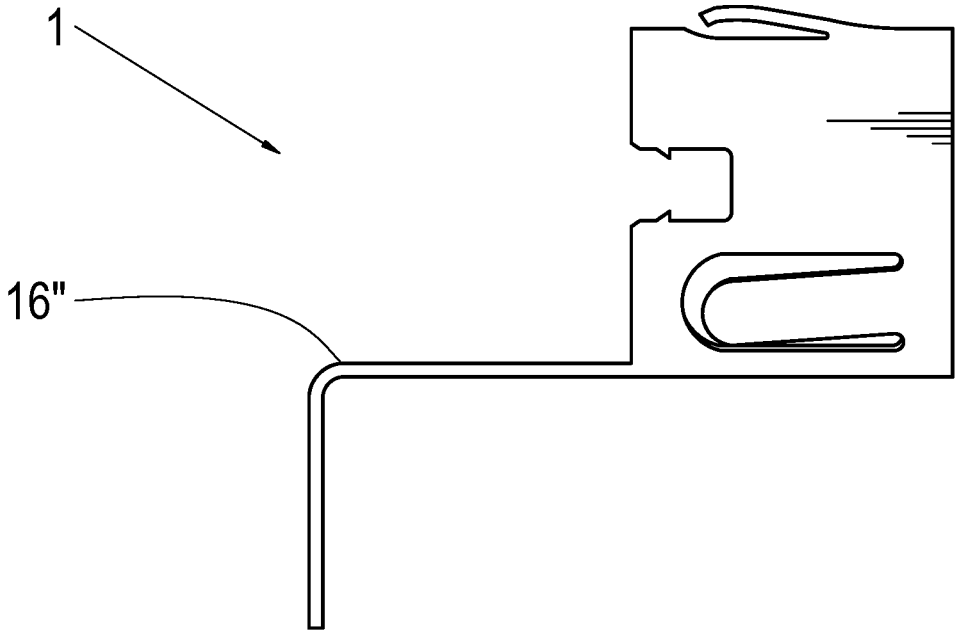

FIGS. 6*a* to *c* show various possible structural designs of the contact pin 16, 16', 16".

In FIG. 6*a* the shield element 1 is represented with the through-contact already described.

FIG. 6*b* shows the shield element 1 with the contact pin 16 which has been realized for use in SMD/SMT technology.

FIG. 6*c* shows a shield element 1 with a contact pin 16 in an angled variant relative to the horizontal fastening of the insulating body 2 on the printed circuit board 5.

In FIGS. 7*a-e* an alternative realization of the fixing of the shield element 1' on the insulating body 2' is shown.

Figure 7A:
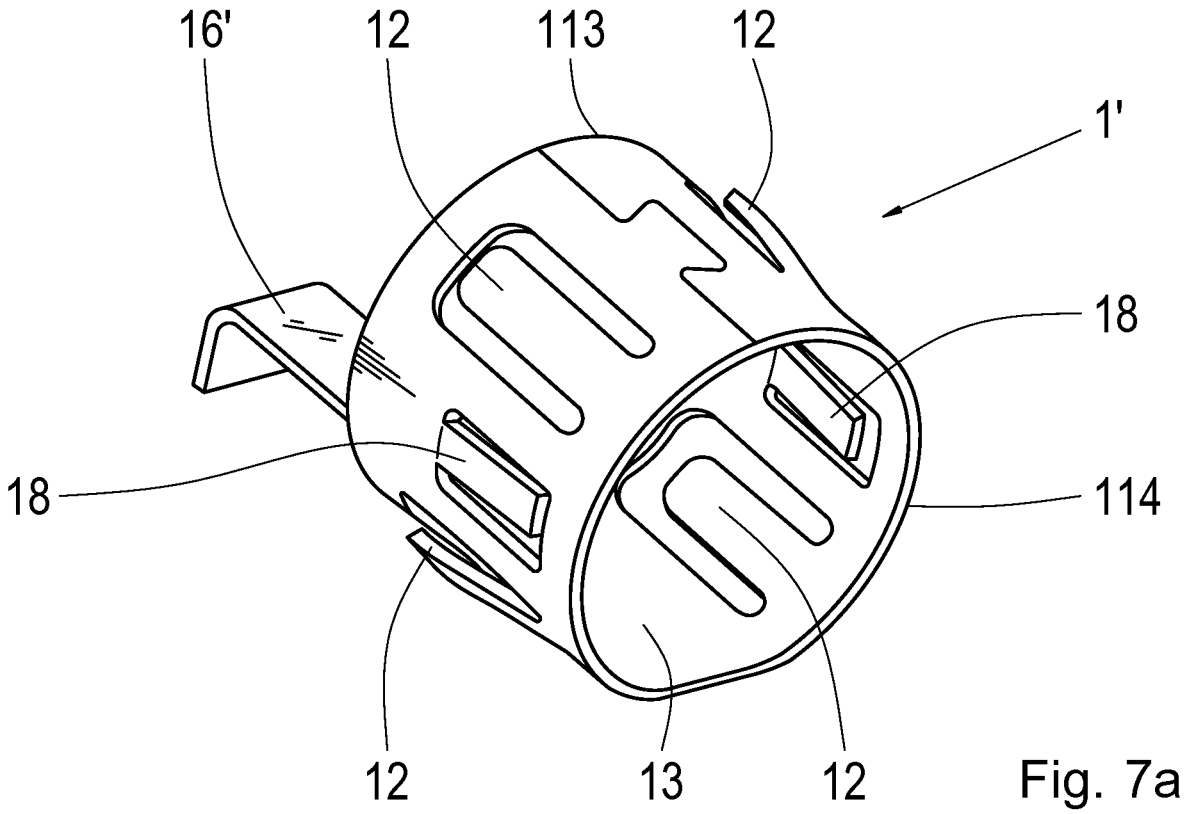
FIGS. 7*a-e* shows a shield element and an insulating body in an alternative structural design.

The alternative shield element 1' is represented in FIG. 7*a* and, in comparison with the aforementioned variant 1, possesses no window-like recesses 14 on its first free-standing edge 113. Instead, it possesses several—in this case, two—latching arms 18, free-standing on three sides, jutting inward and pointing in the direction of the second free-standing edge 114, as fastening means.

Figure 7B:
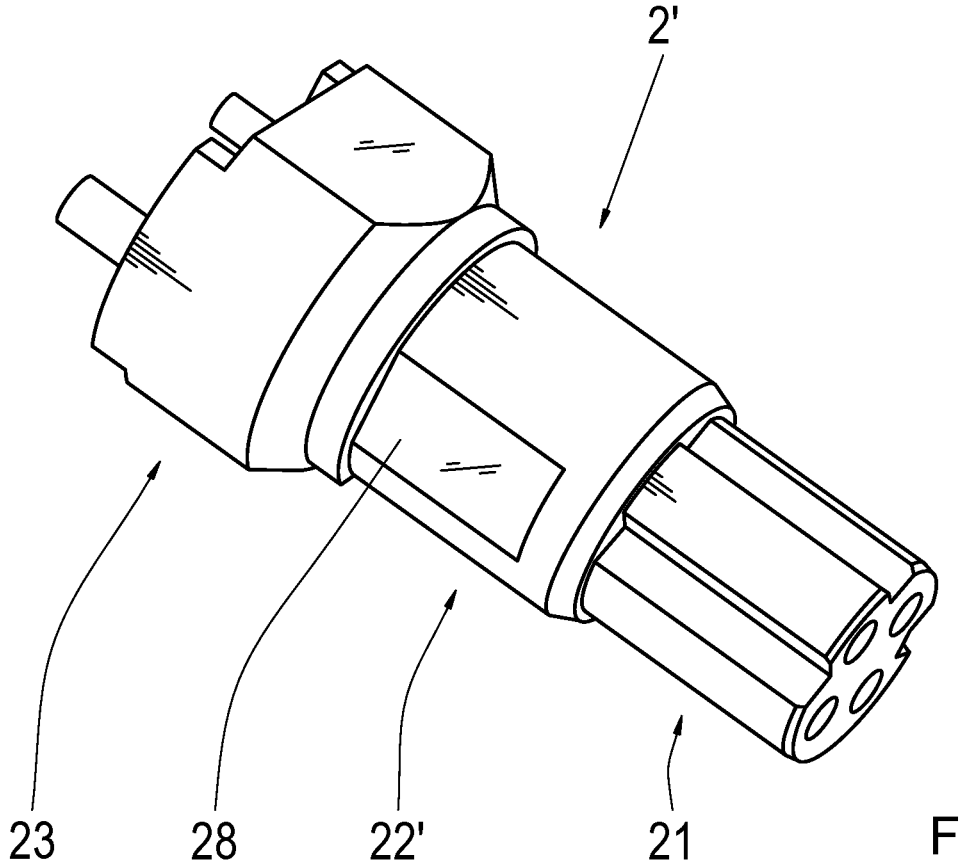
Figure 7C:
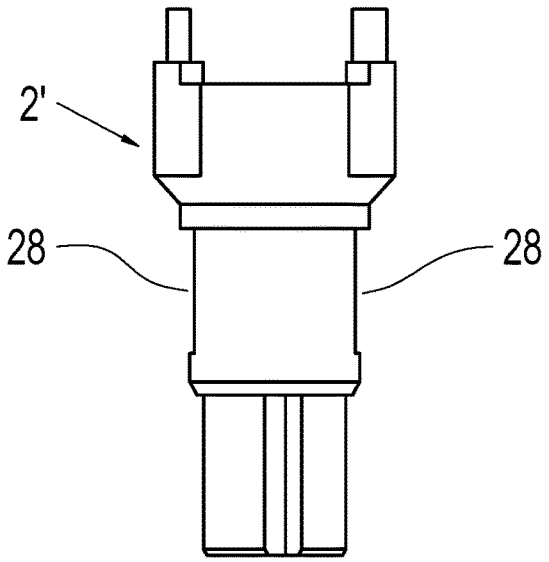
Figure 7D:
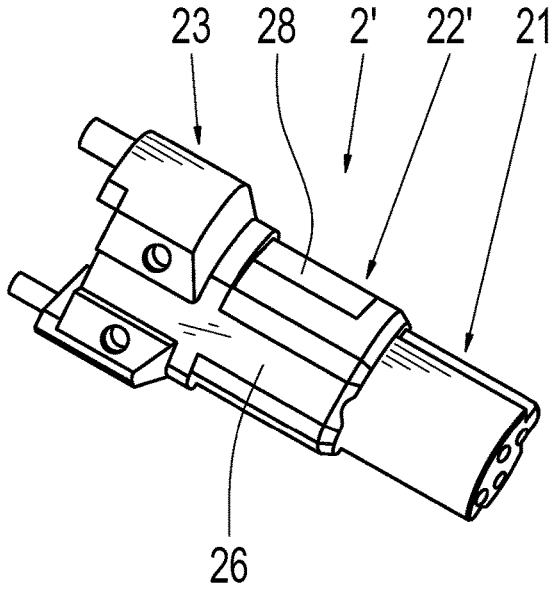

The alternative insulating body 2' is represented in FIGS. 7*b-d* and, in comparison with the aforementioned variant 2, has been modified to the effect that its central portion 22' exhibits no ribs 224. Instead, several—in this case, two—latching recesses 28 for receiving the latching arms 18 have been arranged in the central portion 22'.

Figure 7E:
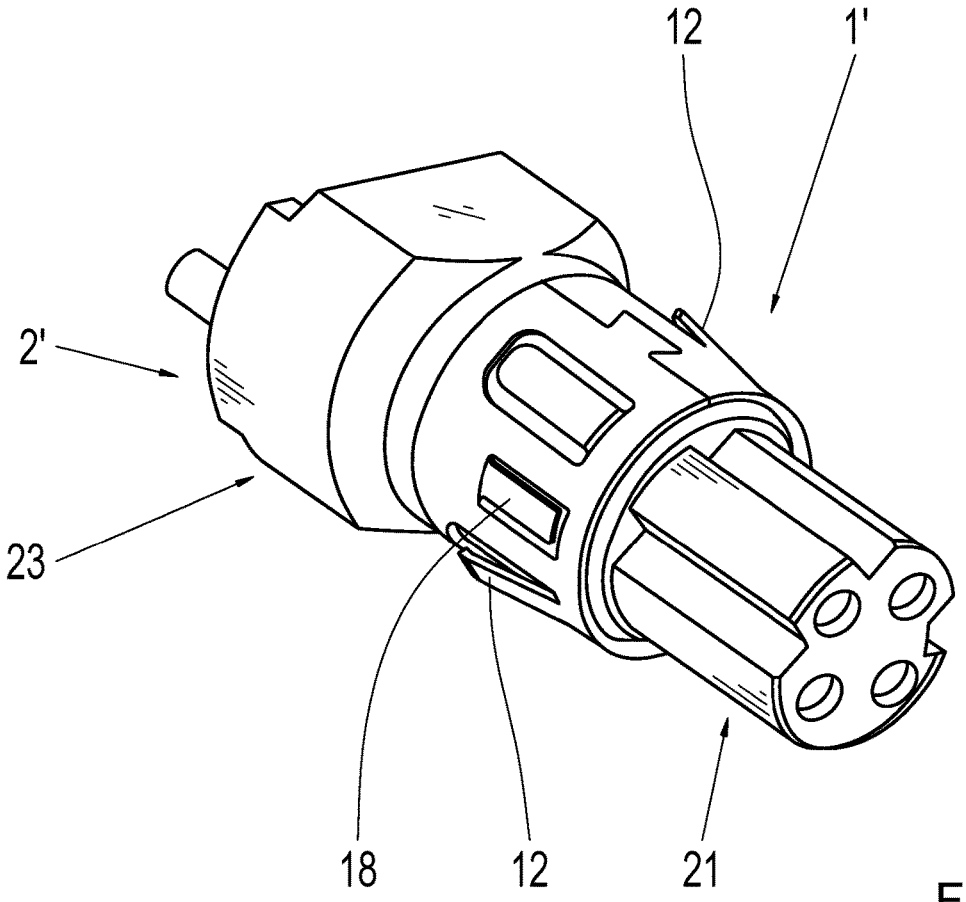

In FIG. 7*e* it is shown, finally, how the alternative shield element 1' latches on the alternative insulating body 2', by the latching arms 18 latching in the latching recesses 28.

Even though various aspects or features of the invention have been shown, in each instance in combination, in the figures, for a person skilled in the art it is apparent—unless otherwise stated—that the combinations represented and discussed are not the only ones possible. In particular, units or complexes of features, corresponding to one another, from different embodiments can be interchanged with one another.

LIST OF REFERENCE SYMBOLS

1, 1' shield element
11 sheet, bent in the form of a hollow cylinder
111, 112 first edges of the sheet
113, 114 second, free-standing edges of the sheet
12 contact tabs
13 flattened region
14 window-like recesses
143, 163 barbs
16, 16', 16" soldering pin, ground terminal
18 latching arms
2, 2' insulating body
21 plug-in region
211 socket contact opening
22, 22' central portion
223 flattened section
224 ribs
23 coupling region
25, 25' guide pegs
26 receptacle
28 latching recesses

3 connector housing, built-in housing
4 housing wall
5 printed circuit board

The invention claimed is:

1. A printed-circuit-board connector, comprising:

an insulating body (2, 2') configured to be fastened on a printed circuit board;

a shield element (1, 1') configured to be soldered to the printed circuit board; and a metallic connector housing (3) configured to be incorporated into a housing wall (4) of a device housing surrounding the printed circuit board, wherein the shield element (1, 1') is one piece, formed from a metallic sheet (11) bent substantially in the form of a hollow cylinder, and positively grasps a substantially cylindrical central portion (22, 22') of the insulating body (2, 2'), wherein the shield element (1, 1') has radially outwardly jutting contact tabs (12) which electrically contact the connector housing (3), wherein the shield element (1, 1') has a ground terminal (16, 16', 16") for contacting a ground contact of a printed circuit board (5), wherein the insulating body (2, 2') has, adjoining its central portion (22, 22'), a plug-in region (21) and, situated opposite, a coupling region (23), wherein the shield element (1, 1') is capable of being plugged from a direction of the plug-in region onto the central portion (22, 22') of the insulating body (2, 2'), and wherein, in an assembled state, the metallic connector housing (3) is floatingly arranged relative to the shield element (1, 1') to compensate tolerances between the printed circuit board and the housing.

2. The printed-circuit-board connector as claimed in claim 1, wherein there is a gap between two first edges (111, 112) of the metallic sheet (11) which has been bent substantially in the form of a hollow cylinder, or the two first edges (111, 112) abut one another in an unfastened manner.

3. The printed-circuit-board connector as claimed in claim 1, wherein two first edges (111, 112) of the metallic sheet (11) which has been bent substantially in the form of a hollow cylinder have been fastened to one another.

4. The printed-circuit-board connector as claimed in claim 3, wherein the two first edges (111, 112), abutting one another, of the metallic sheet (11) which has been bent so as to be substantially hollow and cylindrical have, for their reciprocal fastening, a shape similar to a piece of a jigsaw puzzle.

5. The printed-circuit-board connector as claimed in claim 1, wherein a diameter of the coupling region (23) is larger than a diameter of the central portion (22, 22'), and wherein the diameter of the central portion (22, 22') is at least as large as a diameter of the plug-in region (21).

6. The printed-circuit-board connector as claimed in claim 1, wherein the shield element (1, 1') is capable of being fixed to the insulating body (2, 2').

7. The printed-circuit-board connector as claimed in claim 6, wherein the insulating body (2) has on its central portion (22), adjoining the coupling region (23), several right-parallelepipedal molded-on parts, namely ribs (224), wherein the shield element (1) possesses window-like recesses (14), open toward its free-standing edge (113) adjoining the coupling region (23) in a plugged state, for grasping these ribs (224), wherein the shield element (1) has on two inner edges, situated opposite one another, of these window-like recesses (14), in each instance, barbs (143) for fixing the plugged-on shield element (1) to the insulating body (2).

8. The printed-circuit-board connector as claimed in claim 6, wherein the ground terminal is constituted by a soldering pin (16, 16', 16"), and wherein the soldering pin (16, 16', 16") possesses at least one barb (163) with which it has been fixed in a receptacle (26) of the insulating body (2).

9. The printed-circuit-board connector as claimed in claim 6, wherein the insulating body (2') has on its central portion (22') several latching recesses (28), and wherein the shield element (1') has several latching arms (18), free-standing on three sides and jutting inward, which in a mounted state have been latched in the latching recesses (28), pointing in the direction of the plug-in region (21), and thereby prevent the shield element (1') from being withdrawn from the insulating body (2') in the plug-in direction.

10. The printed-circuit-board connector as claimed in claim 1, wherein the shield element (1, 1') is a stamped and bent part.

11. A method for mounting the printed-circuit-board connector as claimed in claim 1, comprising the following steps:

plugging the shield element (1, 1') onto the central portion (22, 22') of the insulating body (2, 2'), contrary to the plug-in direction, and fixing the shield element to the insulating body (2, 2'); and pushing the insulating body (2, 2') with its plug-in region (21) and its central portion (22, 22') into the connector housing (3), whereby the contact tabs (12) of the shield element (1, 1') contact the connector housing (3) electrically.

12. The method for mounting the printed-circuit-board connector as claimed in claim 11, wherein, prior to pushing the insulating body into the connector housing, the insulating body (2, 2') with contacts located in the insulating body (2, 2') is soldered on the coupling side to terminals of the printed circuit board (5), and wherein, prior to pushing the insulating body into the connector housing, the connector housing (3) is incorporated into a housing wall (4) of a device housing, and wherein, between plugging the shield element onto the central portion (22, 22') of the insulating body (2, 2') and pushing the insulating body into the connector housing, the shield element (1, 1') is soldered by its soldering pin (16, 16', 16") onto a ground terminal of the printed circuit board (5).

13. The printed-circuit-board connector as claimed in claim 1, wherein the radially outwardly jutting contact tabs (12) and the ground terminal (16, 16', 16") are arranged axially spaced from one another at opposite ends of the shield element (1, 1').

14. The printed-circuit-board connector as claimed in claim 1, wherein, in an assembled state, the metallic connector housing (3) overlaps the central portion (22, 22') but not the coupling region (23) of the insulating body (2, 2').

* * * * *